United States Patent [19]

Garofalo

[11] 4,279,040

[45] Jul. 21, 1981

[54] DIVING MASK

[75] Inventor: Giovanni Garofalo, Rapallo, Italy

[73] Assignee: AMF Incorporated, White Plains, N.Y.

[21] Appl. No.: 179,357

[22] Filed: Aug. 18, 1980

[30] Foreign Application Priority Data

Aug. 28, 1979 [IT] Italy ..... 15252/79[U]

[51] Int. Cl.[3] ..... A61F 9/02

[52] U.S. Cl. ..... 2/428

[58] Field of Search ..... 2/428, 429, 430, 9, 2/439, 440

[56] References Cited

U.S. PATENT DOCUMENTS 4,087,865 5/1978 Garofalo ..... 2/428

4,171,543 10/1979 Cressi ..... 2/428

*Primary Examiner*—Peter P. Nerbun

*Attorney, Agent, or Firm*—George W. Price; Walter Lewis

[57] ABSTRACT

A diving mask comprising an eyeglass mounting frame; an outer frame made in two pieces which can be connected together by means of coupling members; and a rubber face piece provided with a front aperture, the peripheral rim of which overlaps the outer rim of the said eyeglass mounting frame, and is clamped between the outer rim of the said eyeglass mounting frame and the internal rim of the said outer frame; and fastening means on the outer frame and on the eyeglass mounting frame for fastening the said members together at least in correspondence of the mask median axis.

4 Claims, 3 Drawing Figures

DIVING MASK

BACKGROUND AND SUMMARY OF THE INVENTION

The present invention has for its object a diving mask of the binocular or the single glass pane type, and provided with a nose portion, in which the glass pane or the eyeglasses are enclosed in an eyeglass mounting frame made in one piece, the rubber face piece of the diving mask being clamped between the outer rim of the said eyeglass mounting frame and the inner rim of an outer frame made in two pieces which can be connected together by means of coupling members, means being provided on the said outer frame and on the eyeglass mounting frame for connecting said frames together in correspondence of the mask median axis.

BRIEF DESCRIPTION OF THE DRAWINGS

Further characteristic features and advantages of the diving mask according to the invention will become more clearly apparent in the course of the following specification, made with reference to the accompanying drawings, in which.

DESCRIPTION OF THE PREFERRED EMBODIMENT OF THE INVENTION

Figure 1:
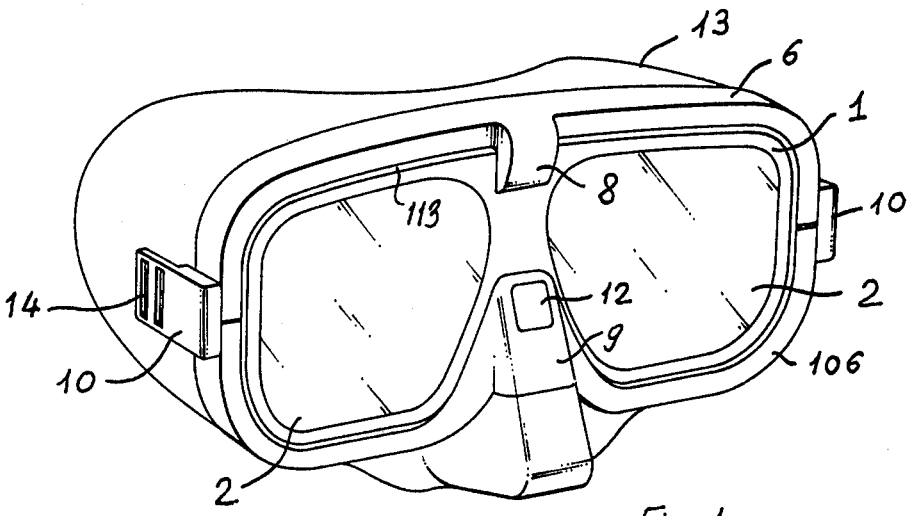
FIG. 1 is a perspective front view of the diving mask according to the invention.
Figure 2:
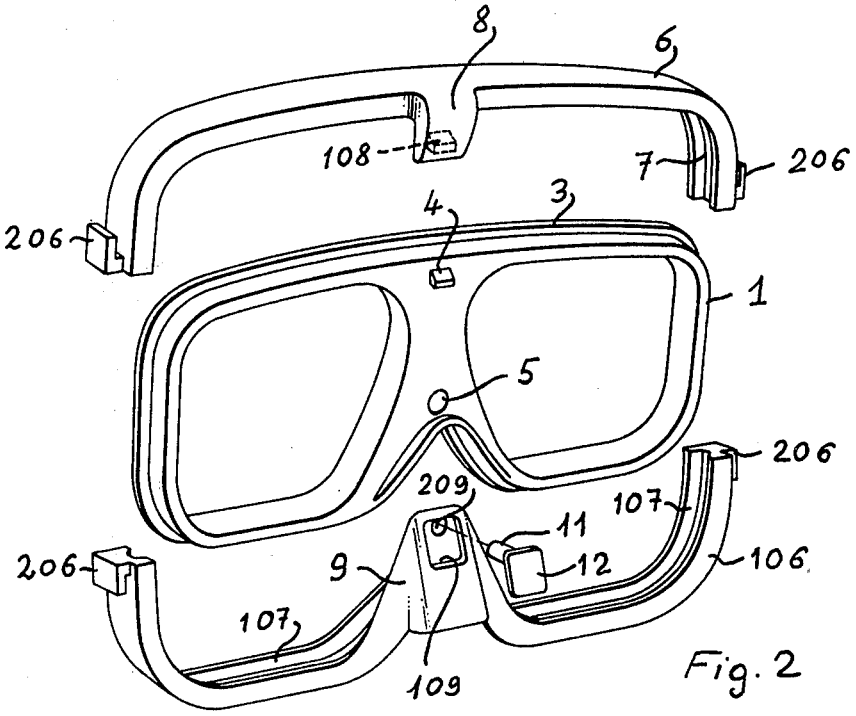
FIG. 2 is an exploded perspective view of the eyeglass frame and the outer frame of the mask of FIG. 1.
Figure 3:
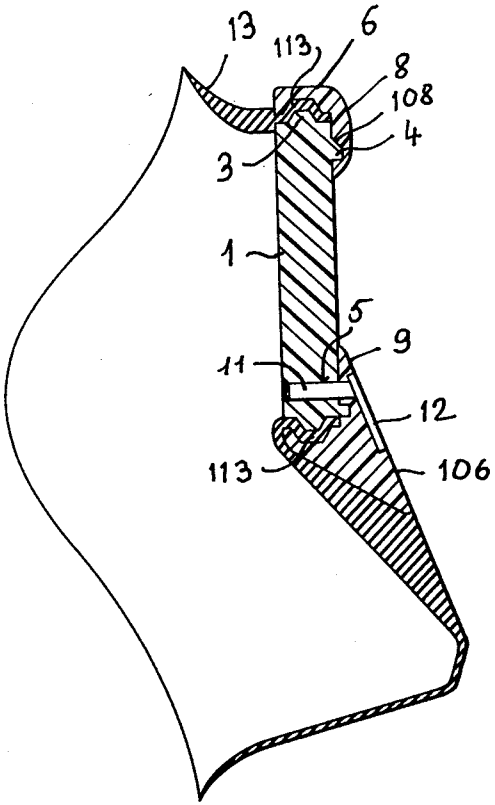
FIG. 3 is a cross section through the median axis of the mask of FIG. 1.

Referring to the drawings, there is shown a diving mask comprised of an eyeglass mounting frame 1, in which the eyeglasses 2 are firmly fastened. The peripheral rim of the frame 1 is provided with a profiled, radially outwardly projecting rib 3.

In the intermediate upper portion of the mounting frame 1 there is formed a fastening dog 4 which protrudes from the upper front side of the frame. On that same side, a bore 5 is also provided in the lower frame end.

The eyeglass mounting frame 1 is encompassed by an outer frame made in two pieces 6, 106 which are connected together at both side edges of the mounting frame 1. On their inner edge, the said outer frame pieces 6, 106 are provided with a groove 7, 107 of a form which is complementary to the profile of the peripheral rim of the eyeglass mounting frame 1.

The outer frame piece 6 is provided in its intermediate portion with a downwardly directed extension 8 with a dog receiving cavity 108 in its inner side, in which the dog 4 is to be fitted.

On its intermediate portion, the frame piece 106 is in its turn provided with an upwardly directed extension 9 having in its outer side a cavity 109 with a through bore 209 which in the assembled condition of the diving mask, is set into axial alignment with the bore 5 in the mounting frame 1. On both ends of the outer frame pieces 6, 106 there are integrally formed the L-shaped extensions 206 on which the connecting sliders 10 are engaged by a slide movement, as will be disclosed hereinafter.

11 denotes a fastening pin having a diameter that matches the diameter of bores 5 and 209, and a head 12 which is so shaped that it can be fitted in the cavity 109 of the outer frame piece 106.

13 denotes the rubber face piece of the diving mask. The said face piece is provided in its fore end with an opening whose peripheral rim 113 is to be applied all around the rim of the mounting frame 1. Thereafter, both outer frame pieces 6, 106 will be applied on the peripheral rim 113, and will be latched together by means of the sliders 10, while being careful to have the dog 4 inserted in the cavity 108, the pin 11 having been previously fitted in the bores 209 and 5, so that the intermediate portions of the outer frame pieces 6, 106 will be firmly fastened to the mounting frame 1.

The sliders 10 are provided, in a conventional manner, with means (slits 14) for securing the strap which permits to wear the diving mask.

The thus constructed diving mask is easy and reliable to be assembled, and it can be made entirely with molden plastics pieces, and has first-rate water-tight properties.

I claim:

1. A diving mask comprising an eyeglass mounting frame; an outer frame made in two pieces which can be connected together by means of coupling members; and a rubber face piece provided with a front aperture, the peripheral rim of which overlaps the outer rim of the said eyeglass mounting frame, and is clamped between the outer rim of the said eyeglass mounting frame and the internal rim of the said outer frame; and fastening means on the outer frame and on the eyeglass mounting frame for fastening the said members together at least in correspondence of the mask median axis.

2. A diving mask according to claim 1, in which the peripheral rim of the eyeglass mounting frame is provided with an omega-like profile, and the outer frame is provided with a groove of a shape being complementary to the profile of the rim of the eyeglass mounting frame.

3. A diving mask according to claims 1 or 2, in which the said fastening means comprise a dog which protrudes from the front side of the eyeglass mounting frame, and is inserted in a complementary hole which is formed in an extension being integral of one of the two half outer frames, the other half outer frame being provided with an extension having a through bore into alignment with a corresponding bore in the eyeglass frame, a connecting pin being inserted in the said bores.

4. A diving mask according to claim 3, in which the two outer frame pieces have their ends provided with guide means in which sliders are fitted by a slide movement, for connection of the two outer frame halves.

* * * * *